United States Patent [19]

Grant

[11] 4,167,397

[45] Sep. 11, 1979

[54] COAL DESULFURIZATION

[75] Inventor: Stephen L. Grant, Stow, Ohio

[73] Assignee: Standard Oil Company, Cleveland, Ohio

[21] Appl. No.: 891,960

[22] Filed: Mar. 31, 1978

[51] Int. Cl.[2] ..... C10L 9/10; C10B 57/00

[52] U.S. Cl. ..... 44/1 R; 201/17

[58] Field of Search ..... 44/1 R; 201/17

[56] References Cited

U.S. PATENT DOCUMENTS

| | | | |
|---|---|---|---|
| 206,266 | 7/1878 | Schroder | 44/1 R |
| 1,007,153 | 10/1911 | Spurrier | 44/1 R |
| 1,685,654 | 9/1928 | Waggoner et al. | 44/1 R |
| 3,252,769 | 5/1966 | Nagelvoort | 44/1 R |
| 3,909,211 | 9/1975 | Diaz et al. | 44/1 R |
| 3,909,213 | 9/1975 | Sanders | 44/1 R |

*Primary Examiner*—Carl Dees

*Attorney, Agent, or Firm*—John E. Miller, Jr.; Herbert D. Knudsen; Larry W. Evans

[57] ABSTRACT

The pyritic sulfur content of coal can be significantly reduced by contacting the coal with an aqueous solution of a salt which increases the dielectric constant of the solution.

8 Claims, 2 Drawing Figures

COAL DESULFURIZATION

BACKGROUND OF THE INVENTION

The present invention relates to a novel chemical leaching process for significantly reducing the pyritic sulfur content of coal.

Processes for removing pyritic sulfur from coal are well known. An example of such a process is TRW's Meyer's process which is described in U.S. Pat. No. 3,768,988.

Although the Meyer's process is capable of removing significant quantities of pyritic sulfur from coal, it is complex to carry out and further involves the use of a comparatively expensive reagent.

Accordingly, it is an object of the present invention to provide a novel process for removing pyritic sulfur from coal which can be carried out very simply and easily and which employs inexpensive and readily available reagents.

SUMMARY OF THE INVENTION

This and other objects are accomplished by the present invention which is based on the discovery that significant amounts of pyritic sulfur contained in coal can be removed from the coal by contacting the coal with an aqueous solution containing a salt of a Group I or II metal which increases the dielectric constant of the solution. More specifically, it has been found in accordance with the present invention that an aqueous solution of a Group I or II metal salt when contacted with coal will cause a physical breaking-up of the inorganic material of the coal (i.e. the clay and/or ash). Simple agitation of the coal will then cause at least some of the ash as well as a significant amount of unreacted pyritic sulfur to be separated from the coal, thereby reducing the pyritic sulfur content of the coal product.

Thus, the present invention provides a novel technique for reducing the pyritic sulfur content of coal comprising contacting the coal with an aqueous solution containing a salt of a Group I or II metal which increases the dielectric constant of the solution.

In addition, the present invention provides an improvement in the known process for reducing the ash content of coal by subjecting coal to a density separation procedure, the improvement in accordance with the present invention comprising contacting the coal prior to or simultaneously with the density separation operation with an aqueous Group I or II metal salt solution having a dielectric constant greater than that of water.

DETAILED DESCRIPTION

Figure 1:
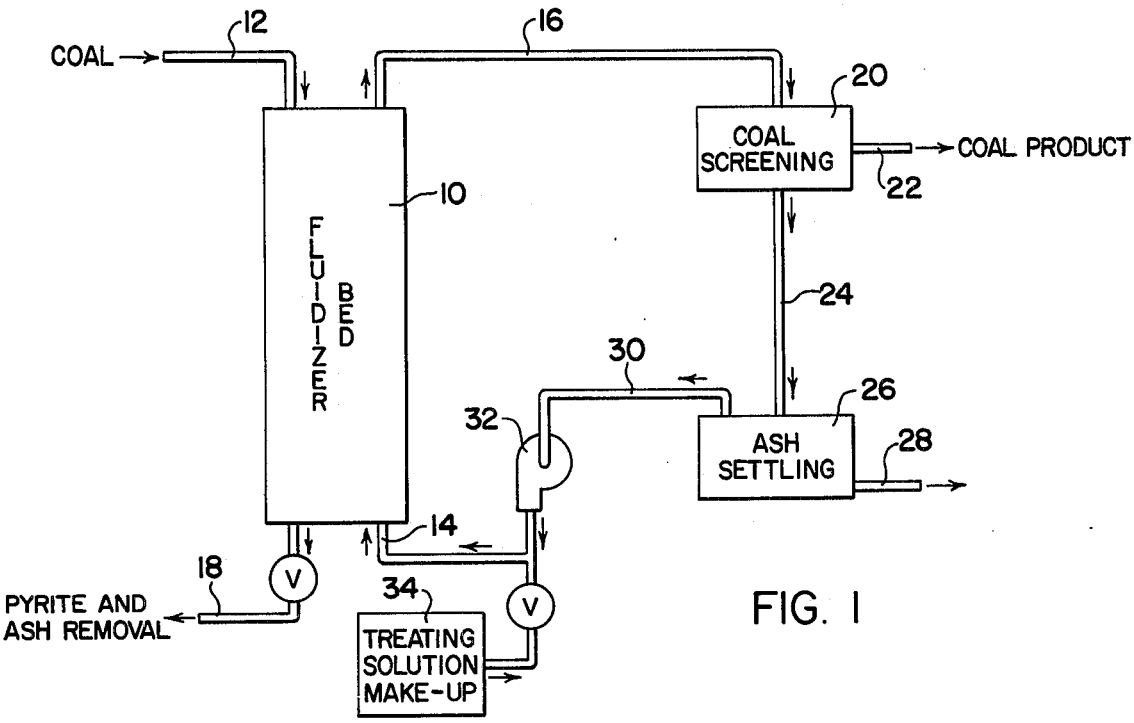
FIG. 1 is a schematic view of one system for carrying out the present invention.
Figure 2:
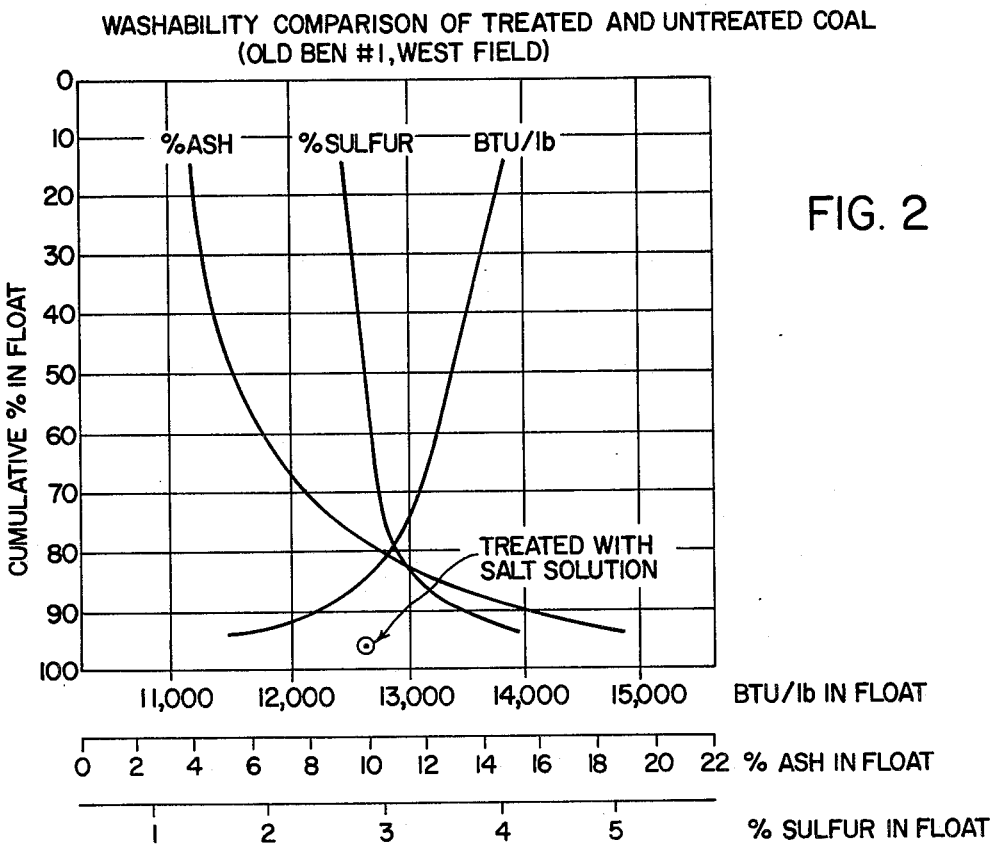
FIG. 2 is a graph illustrating the improved results obtained by the inventive process.

The inventive process is applicable to all types of coal. In this regard, it is well known that the chemical composition and physical structure of coal obtained from different locations can vary widely. The inventive process can be practiced on all types of coal, although the amount of desulfurization attainable varies with the particular coal being processed.

In this regard, it has been found that the inventive process works best with coals where the ash and the pyrite occur in discrete striations in the coal matrix. Thus, in the preferred embodiment coals with this physical structure are processed.

The coal to be treated by the inventive process can be of any size although it should be in particulate form since this increases the contact area of the aqueous treating solution with the coal mass. Preferrably, the particulate coal should have a particle size no larger than about ¼ inch since the efficiency of the process decreases at higher particle sizes. Below this value, however, it has been found that there is no particular criticality in the particle size of the coal, essentially the same results being obtained regardless of particle size. It is desirable, however, to avoid using coal of too fine a particle size, since as well known physical separation of extremely fine particles from an aqueous solution can be difficult. For most convenient operation, the particle size of the coal should be roughly 30 mesh to ⅜ inch.

The treating composition used to process coal in accordance with the present invention is an aqueous solution containing a salt of a Group I or II metal which has the capability of increasing the dielectric constant of the aqueous solution. Thus, the dielectric constant of the treating solutions of the invention are greater than the dielectric constant of pure water. In addition, the particular salt selected should not tend to oxidize components of the coal.

In this regard, there are many salts and/or ions which are capable of oxidizing the sulfur and/or other components of coal. For example, $Fe_2(SO_4)_3$ which is used in the above-mentioned Meyer's process works by oxidizing the pyritic sulfur in the coal. Furthermore, commonly assigned U.S. applications Ser. No. 891,961 filed Mar. 31, 1978, Ser. No. 891,962 filed Mar. 31, 1978 and now U.S. Pat. No. 4,162,898, and Ser. No. 892,000 filed Mar. 31, 1978 and now U.S. Pat. No. 4,137, 050 teach that various other salts in aqueous solutions will serve to oxidize the pyritic and in some instances both the pyritic and organic sulfur in coal. These types of salts are not employed in the inventive process. On the contrary, the salts used in the inventive process merely function to increase the dielectric constant of the aqueous solution, and by this means cause a physical breaking-up of the clay or other inorganics in the coal which in turn allows the coal to be broken up much more easily when subjected to simultaneous or subsequent agitation.

Examples of salts which have been found effective in the present invention are sodium chloride, sodium phosphate, calcium chloride, tin chloride, potassium chloride, nickel chloride, ammonium chloride, calcium sulfate and sodium carbonate. Sodium chloride is preferred since it is cheap and readily available.

It is also preferable that the aqueous treating solution be slightly basic in character, and thus it is desirable to include in the treating solution a small amount of a base. Any base which does not adversely effect the sulfur removal procedure of the invention can be employed. Bases such as sodium hydroxide, potassium hydroxide, ammonium hydroxide and organic bases can be employed. Sodium hydroxide is preferred since it is cheap and readily available.

The concentrations of the various ingredients in the aqueous treating solution can vary widely. The amount of salt should normally be between 0.1 normal and the saturated value, a concentration of 0.5 to 2 normal being preferred, and a concentration of 1 normal being most preferred. If a base is included in the treating solution it should have a concentration between about 0.01 and the saturated value, with a concentration of 0.01 to 1 being preferred and a concentration of 0.05 normal being most preferred.

The amount of treating solution contacted with a given amount of coal is also not critical. As a practical matter, the coal/treating solution ratio should be at least about 1/20 in order for the process to be economic although lower coal/treating solution ratios can be employed if desired. Furthermore, when the coal/treating solution ratio exceeds about 1.5/1, the mixture becomes too viscous. Therefore, it is preferable to operate with a coal/treating solution ratio between about 1/20 to 1.5/1. Preferably, the coal/treating solution ratio is about 1/5.

The temperature at which the coal is contacted with the treating solution can also vary widely. Not much difference in results has been noted when the process is run at 100° C. rather than 20° C., and therefore it is preferable to carry out the process at ambient temperatures, although any other temperatures can be employed as desired.

The process pressure is not critical and the process can be carried out at atmospheric, subatmospheric or superatmospheric pressure.

The contact time of the treating solution with the coal necessary for significant sulfur removal varies depending on a number of factors such as the concentration of the salt in the treating solution and the particular coal being processed. Normally, contact times on the order of 5 minutes to 24 hours are employed, with a contact time of about 15 minutes to 3 hours being suitable in many instances. A contact time of about 1 hour is preferred.

In order to cause significant separation of the unreacted pyritic sulfur from the organic matrix of the coal, the coal which has been contacted with the aqueous salt solution should be agitated. Coal agitation is accomplished in accordance with the present invention with the coal being an aqueous slurry. The agitation is most easily accomplished by mechanical mixing, although any other known technique such as, for example, ultrasonic sound, can be used. The agitation procedure can be accomplished simultaneously with the treating procedure, in which case the aqueous coal slurry is composed of the particulate coal and the treating solution of the present invention. Alternatively, the coal agitation can be accomplished after the treating procedure, coal separated from the treating solution being admixed with water to form an aqueous coal slurry for agitation.

In accordance with the preferred embodiment of the invention, the agitation procedure is carried out during the density separation of the coal. In this regard, it is conventional in the coal processing industry to subject raw coal to a density separation procedure (i.e. a float-sink procedure) before it is used. Such density separation procedures serve to remove some of the ash content from the coal, thereby producing a coal product with higher heat content. Industrially, density separation of coal is accomplished either by the use of jigs, in which case separation occurs by pulsing air into the bottom a container containing an aqueous slurry of the coal, or by fluid-bed techniques, in which case a liquid usually water upflowing through the coal causes the separation. In either instance, the coal in aqueous slurry is subjected to significant agitation. In accordance with the present invention, this agitation is sufficient to cause separation of pyrites from coal treated as described above, and hence the inventive process is most easily carried out by using such coal separation techniques for the agitation step in the inventive process.

In a particularly preferred embodiment of the present invention, the coal agitation step and the coal treating step are accomplished simultaneously with conventional density separation step. This is easily accomplished by simply adding the salt and base if desired necessary to form the treating solution to the water used in the jig or fluidized-bed in which the conventional density separation occurs.

The amount of agitation necessary to cause significant separation of pyrites from coal treated with a salt solution in accordance with the present invention varies widely and depends primarily on the type of coal being processed. The optimal amount of agitation for particular coal can be easily determined by one skilled in the art through routine experimentation.

In order to illustrate the preferred embodiment of the present invention in which the coal treating step and the agitation step of the inventive process are carried out simultaneously, FIG. 1 is presented. In accordance with the system shown in this figure, particulate coal is fed into fluidizing-bed 10 via coal inlet line 12. In fluidizing-bed 10, the particulate coal is maintained in a fluidized state by upflowing treating solution which enters the fluidized-bed via supply line 14. After a suitable residence time for the coal-liquid contact, treating solution flow via supply line 14 is increased to be fast enough so that the majority of the particulate coal is carried with the treating solution overhead and discharged from the fluidized-bed 10 via exit line 16. The portions of the coal which are too heavy to be carried along with the outflowing liquid, namely heavier ash particles and pyrite, fall to the bottom of the fluidized bed and are periodically removed through pyrite and ash removal line 18.

In addition to coal particles, the upflowing liquid passing out of fluidized-bed 10 and through exit line 16 also contains fine clay particles. In order to remove these fine clay particles, the slurry in line 16 is passed through a coal screening station 20 where the coal slurry is passed through a screen of a size such that the majority of the coal particles are removed from the slurry but the fine clay particles are allowed to pass through. The coal particles are recovered via coal recovery line 22, while the remainder of the slurry containing predominantly ash particles is transferred via line 24 to ash settling tank 26. In ash settling tank 26 the solids of the slurry are allowed to settle out and are discharged via line 28 while the liquid portion of the slurry, which comprises the treating solution used in the inventive process, is recovered and transferred via line 30 and pump 32 to treating solution entry line 14 where it is passed again through fluidized-bed 10. If desired, additional amounts of treating solution can be supplied from treating solution make-up line 34.

In order to more thoroughly describe the present invention the following example is presented.

EXAMPLE 1

A washability study was performed on an Indiana No. 5 seam coal obtained from the Old Ben Coal Company Mine #1, West Field. A number of samples of this coal were ground to a particule size of $\frac{3}{8}$ inch × 10 mesh and subjected to conventional density separations at different fluid densities. The BTU/lb. in the float, the ash content in the float and the sulfur content in the float were obtained and plotted against the cumulative weight percent of the coal in the float. The results are shown in FIG. II.

A similar sample of the same coal ground to the same particle size was then contacted with an aqueous solution containing 1N sodium chloride and 0.05N sodium hydroxide in a liquid fluidized-bed for 3 hours at ambient temperature. The coal sample contained 14.95% ash, 4.00% sulfur (1.42% pyritic, 0.26% sulfate, 2.32% organic) and had a heating value of 11,972 BTU/lb. After treatment a float yield of 95.7% was achieved with a 1.58 specific gravity solution. This coal product contained 10.01% ash, 2.88% sulfur (0.85% pyritic, 0.13% sulfate, and 1.90% organic) and had a heating value of 12,647 BTU/lb. The data point developed by this example is also set forth on the attached FIG. I.

It will be noted from the foregoing example, especially considering FIG. II, that the coal product produced by the inventive process has a significantly reduced sulfur content and a significantly reduced ash content as compared to coals which are subjected to gravity separation without first being subjected to the inventive sulfur removal procedure.

EXAMPLES 2 THROUGH 10

A number of different coals having a particle size of ⅜ inch×100 mesh were each mixed with the treating solution used in Example 1 and the composition so obtained heated to reflux. After refluxing for 3 hours, the solids were removed from the solution and subjected to a conventional float-sink operation with carbon tetrachloride. The identities of the different coals and the results obtained are set forth in the following Table 1.

TABLE 1

| Example | Coal | Sulfur Content Initial | Sulfur Content Final | % Total S Removed |
|---|---|---|---|---|
| 2 | Pittsburgh #8 Ireland mine, W. Va. | 4.26 | 2.91 | 32 |
| 3 | Indiana #5 (West Field) | 4.41 | 2.71 | 38 |
| 4 | Indiana #5 (Log Creek) | 3.06 | 2.66 | 13 |
| 5 | Illinois #6 | 2.41 | 2.28 | 5 |

TABLE 1-continued

| Example | Coal | Sulfur Content Initial | Sulfur Content Final | % Total S Removed |
|---|---|---|---|---|
| 6 | Old Ben #24 Illinois #6 | 2.35 | 1.87 | 20 |
| 7 | Old Ben #26 Illinois #6 | 1.11 | 0.96 | 14 |
| 8 | Old Ben #81 Ohio #8 | 2.74 | 2.59 | 5 |
| 9 | Ohio #6 | 2.39 | 2.32 | 3 |
| 10 | Ohio #6 | 2.90 | 2.77 | 4 |

EXAMPLES 11 THROUGH 16

The procedure of Examples 2 to 10 was repeated on 40×60 mesh Indiana No. 5 seam coal from the Old Ben Company's No. 1 mine, West Field using various different treating solutions. The different salt solutions used in the examples as well as the results obtained are set forth in the following Table 2.

TABLE 2

| Ex. | Aqueous Treating Solution | Sulfur Content Initial | Sulfur Content Final | % Total S Removed | Heat Content BTU/Lb. Initial | Heat Content BTU/Lb. Final |
|---|---|---|---|---|---|---|
| 11 | 1N NaCl | 4.41 | 4.16 | 6 | 12,308 | 12,242 |
| 12 | 1N NaCl . 5N NaOH | 4.41 | 3.66 | 17 | — | — |
| 13 | 1N NaCl . 0.05N NaOH (at reflux) | 4.41 | 2.71 | 38 | 12,308 | 12,730 |
| 14 | 1N NaCl . 0.05N NaOH (ambient) | 4.41 | 2.78 | 37 | — | — |
| 15 | $CaSO_4$ (saturated solution) | 4.41 | 2.77 | 37 | — | — |
| 16 | 1N $NH_4Cl$ | 4.41 | 2.80 | 26 | — | — |

EXAMPLES 17 THROUGH 22

The procedure of Examples 11 to 16 was repeated except that a Pittsburgh No. 8 seal coal from the Ireland Mine, W. Va., was used. The various treating solutions as well as the results obtained are set forth in the following Table 3.

TABLE 3

| Ex. | Aqueous Treating Solution | Sulfur Content Initial | Sulfur Content Final | % Total S Removed | Heat Content BTU/Lb. Initial | Heat Content BTU/Lb. Final |
|---|---|---|---|---|---|---|
| 17* | $CaSO_4$ (saturated solution) | 5.69 | 4.29 | 25 | 12,979 | 13,081 |
| 18** | $CaSO_4$ (Saturated solution) | 5.69 | 4.44 | 22 | 12,979 | 13,402 |
| 19** | 1N $CaCl_2$ | 5.69 | 4.33 | 24 | 12,979 | 13,732 |
| 20 | 1N $SnCl_2$ | 4.26 | 2.75 | 35 | 12,795 | 13,247 |
| 21 | 1N $(NH_4)_2SO_3$ . .05N NaOH | 4.26 | 2.80 | 34 | 12,795 | — |
| 22 | 1N $(NH_4)_2S_2O_8$ . .05N NaOH | 4.26 | 2.83 | 34 | 12,795 | — |

*contact time was 6 hours.
**contact time was 24 hours.

From the foregoing, it can be seen that the inventive process is capable of removing significant quantities of sulfur contained in coal. In addition, it can be seen that as reflected in the increase in heat content of the coal product vis-a-vis the raw coal, the inventive process is also capable when used in combination with a conventional float-sink operation of removing a significant quantity of ash from the treated coal.

Although only a few embodiments of the present invention have been specifically discussed above, it should be appreciated that many modifications can be made without departing from the spirit and scope of the invention. All such modifications are intended to be included within the scope of the present invention, which is to be limited only by the following claims.

I claim:

1. A process for removing pyritic sulfur from coal comprising (1) contacting particulate coal with an aqueous treating solution comprising an aqueous solution containing salt of a Group I or II metal, said treating solution having a dielectric constant greater than the dielectric constant of water, said aqueous salt being incapable of oxidizing the sulfur in said particulate coal, and (2) agitating said coal when in the form of an aqueous slurry to cause pyrites in said coal to be physically separated from the coal.

2. The process of claim 1 wherein said coal is characterized in having discrete striations of ash and pyrite in the coal matrix.

3. The process of claim 2 wherein said treating solution further contains a base.

4. The process of claim 3 wherein contacting of the coal with said treating solution and agitation of said coal are accomplished simultaneously.

5. The process of claim 4 wherein contacting and agitation are accomplished simultaneously with float-sinking of the coal.

6. The process of claim 3 wherein said salt is NaCl.

7. The process of claim 6 wherein said base is NaOH.

8. The process of claim 3 wherein said solution is at least 0.1 normal in said salt and 0.01 normal in said base.

* * * * *